US005651314A

United States Patent [19]

Gentle

[11] Patent Number: 5,651,314

[45] Date of Patent: Jul. 29, 1997

[54] APPARATUS FOR CIRCUMFERENTIAL AND LATERAL ADJUSTMENT OF PLATE CYLINDER

[75] Inventor: Brian Joseph Gentle, Rochester, N.H.

[73] Assignees: Heidelberg Harris, Inc., Dover, N.H.; Heidelberger Druckmaschinen AG, Heidelberg, Germany

[21] Appl. No.: 668,994

[22] Filed: Jun. 21, 1996

Related U.S. Application Data

[63] Continuation of Ser. No. 435,932, May 5, 1995, Pat. No. 5,535,675.

[51] Int. Cl.[6] ..... B41F 13/24

[52] U.S. Cl. ..... 101/248; 74/395

[58] Field of Search ..... 101/247, 248, 101/211, 216, 217, 219, 148, 226; 74/395

[56] References Cited

U.S. PATENT DOCUMENTS

| | | | |
|---|---|---|---|
| 3,308,752 | 3/1967 | Stevenson . | |
| 3,565,006 | 2/1971 | Stewart . | |
| 3,641,933 | 2/1972 | Tafel . | |
| 3,896,724 | 7/1975 | Muselik | 101/248 |
| 3,945,266 | 3/1976 | Dufour . | |
| 4,137,845 | 2/1979 | Jeschke | 101/248 |
| 4,207,815 | 6/1980 | Watanabe . | |
| 4,336,755 | 6/1982 | Liska | 101/248 |
| 4,457,231 | 7/1984 | Kawaguchi . | |
| 4,458,591 | 7/1984 | Guaraldi | 101/247 |
| 4,499,831 | 2/1985 | Anastasio et al. . | |
| 4,566,353 | 1/1986 | Stiff | 101/226 |
| 4,572,074 | 2/1986 | Guaraldi | 101/248 |
| 4,709,634 | 12/1987 | Momot et al. . | |
| 4,741,266 | 5/1988 | Stirbis et al. | 101/248 |
| 4,782,752 | 11/1988 | Etchell | 101/248 |
| 4,879,950 | 11/1989 | Ishii | 101/217 |
| 4,935,683 | 6/1990 | Kobler et al. | 101/148 |
| 5,152,222 | 10/1992 | Okamura et al. | 101/248 |
| 5,209,161 | 5/1993 | Derivi et al. | 101/211 |

*Primary Examiner*—Eugene H. Eickholt
*Attorney, Agent, or Firm*—Kenyon & Kenyon

[57] ABSTRACT

In a rotary printing press, an apparatus for adjusting the lateral and circumferential position of the plate cylinder is provided. The apparatus includes a sleeve having an inner surface with threads disposed thereon; a shaft disposed within the sleeve, and connected to the machine element such that when the shaft moves laterally the machine element is moved laterally, the shaft having an outer surface with threads disposed thereon which engage the threads disposed on the inner surface of the shaft; a gear assembly coupled to the sleeve, such that a rotational movement of the sleeve causes a circumferential movement of the machine element; a first drive for rotating the shaft, such that when the shaft is rotated, the shaft moves the machine element laterally; and a second drive for rotating the sleeve, such that when the sleeve is rotated, the sleeve moves the gear, and the gear rotates the machine element circumferentially.

7 Claims, 4 Drawing Sheets

APPARATUS FOR CIRCUMFERENTIAL AND LATERAL ADJUSTMENT OF PLATE CYLINDER

This application incorporates by reference, in its entirety, the disclosure of application Ser. No. 08/435,932 filed May 5, 1995, and entitled APPARATUS FOR CIRCUMFERENTIAL AND LATERAL ADJUSTMENT OF PLATE CYLINDER. This application is a continuation of application serial number 08/435,932 now U.S. Pat. No. 5,535,675.

FIELD OF THE INVENTION

The present invention relates to an apparatus for adjusting the circumferential and lateral register in a rotary printing press.

BACKGROUND OF THE INVENTION

In a rotary offset printing press, a plate cylinder is disposed in rolling engagement with a blanket cylinder, which in turn contacts the web (the material to be printed upon). In the course of a print run, it is often necessary from time to time to adjust the position of the plate cylinder relative to the blanket cylinder. For example, an adjustment might be necessary so that the image being printed registers (matches) properly with an image already on the web. The register may need adjustment laterally (in the direction of the cylinder axes) or circumferentially (rotationally). Such adjustment might be necessary, for example, in a typical color printing press having four print units, each print unit printing dots of unique color. The combination of these colored dots on the paper creates a colored image. Each set of colored dots must be printed in alignment with the others in order to produce a sharp colored picture. If the dots are printing out of alignment, it is necessary to adjust the register of the print units so that they print their dots in proper alignment.

Apparatuses that adjust the lateral and circumferential position of the print cylinder are known to the art. In some of these apparatuses, the lateral positioner and the circumferential positioner are on opposite sides of the printing press. However, because the positioners are on opposite sides of the printing press, it is difficult for the press operator to make repeated adjustments of the cylinder position.

In other positioning apparatuses, this problem is solved by placing the lateral and circumferential positioners on the same side of the press. These apparatuses are easier to operate and take up less space, but they are complex and, thus, expensive.

SUMMARY OF THE INVENTION

In accordance with the present invention, the shortcomings in the prior art are eliminated by providing lateral and circumferential positioners on the same side of the press by means of a simple design. The design is simple because a single precision-threaded shaft is employed in two different modes of operation, one to accomplish lateral register, and one to accomplish circumferential register.

In accordance with the present invention, a sleeve is provided with inner threads. A precision-threaded shaft is disposed within and is engaged with the threaded sleeve. The shaft is connected to the plate cylinder such that when the shaft moves laterally the plate cylinder is moved laterally. The shaft is driven rotationally by a first drive. Likewise, the threaded sleeve is driven rotationally by a second drive.

The threaded sleeve is connected to the plate cylinder by means of a gear assembly such that when the threaded sleeve moves laterally, the plate cylinder rotates.

In accordance with a further embodiment of the present invention, the gear assembly includes a splined sleeve connected to and disposed coaxially with the plate cylinder, and having an outer surface with a spline disposed thereon. The gear assembly further includes a helical gear which has an inner surface with a groove disposed thereon which engages the spline. The helical gear is rotatably engaged with the threaded sleeve. The helical gear is also externally engaged with a gear attached to the blanket cylinder. A lateral force is applied to the helical gear via the lateral movement of the threaded sleeve such that when the threaded sleeve moves laterally the helical gear is moved laterally and rotates (due to its engagement with the blanket cylinder gear), thereby causing a circumferential movement of the plate cylinder relative to the blanket cylinder.

To actuate a lateral register, the shaft is rotated by the first drive while the sleeve is held immobile. Because of its threaded engagement with the threaded sleeve, the rotating shaft moves laterally, moving the plate cylinder laterally.

To actuate circumferential register, the threaded sleeve is rotated by the second drive while the shaft is held immobile. Because of its threaded engagement with the shaft, the threaded sleeve moves laterally, thereby driving the gear assembly and causing the plate cylinder to rotate circumferentially as described above.

DETAILED DESCRIPTION OF THE INVENTION

Figure 1:
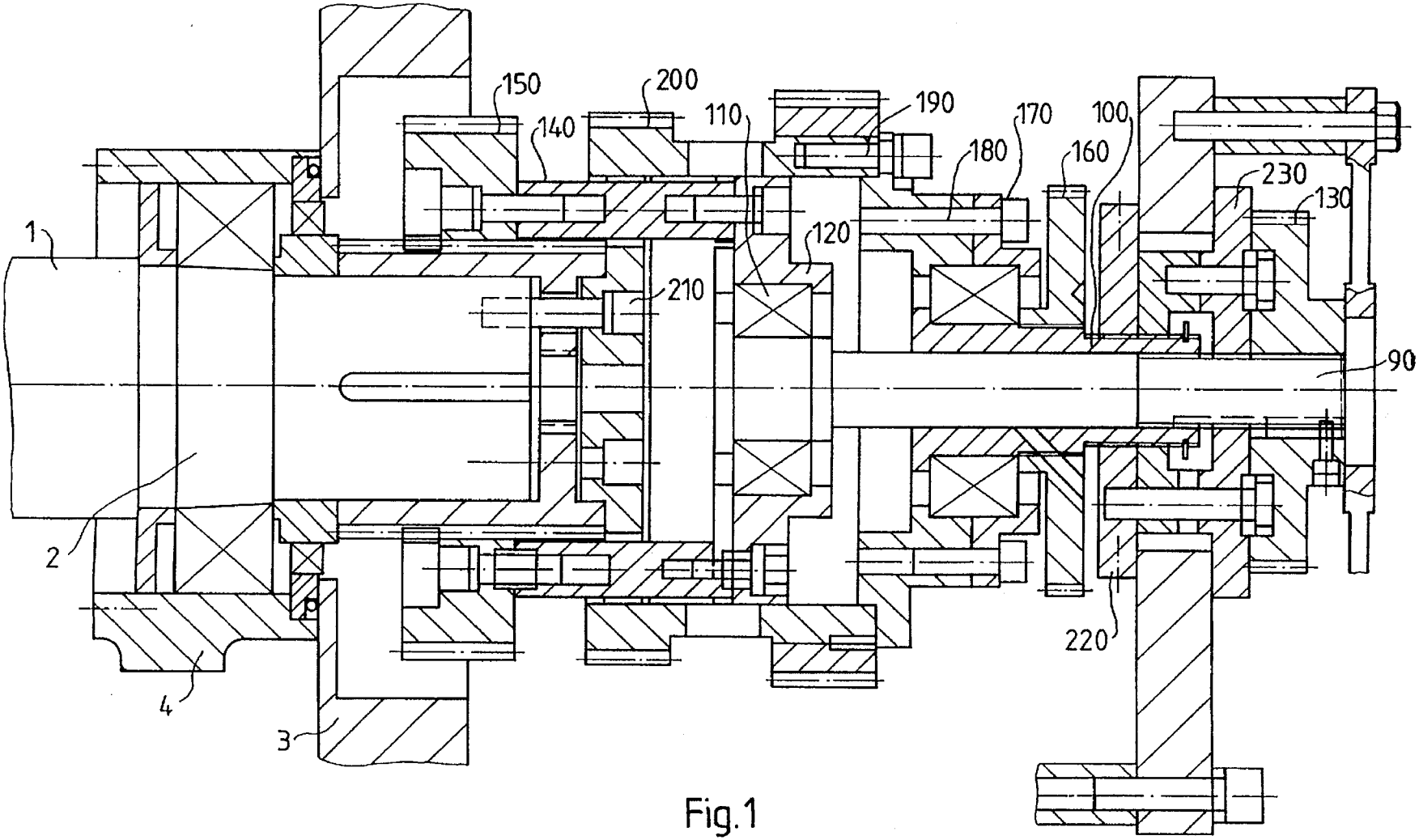
FIG. 1 shows a cross-sectional view of the adjustment-side of a rotary printing press including a prior art lateral/circumferential register.

FIG. 1 shows a prior art device in which the rotational and circumferential register apparatuses are on the same side of the printing press, at the cost of providing two precision-threaded shafts 90, 100. In accordance with this device, a plate cylinder 1 is connected to an adjustment-side journal 2 and a drive-side journal (not shown). The journals are rotatably mounted in their respective side frames 3 by means of bearing assemblies 4.

A first precision-threaded shaft 90 is disposed within a second, hollow, precision-threaded shaft 100. The first shaft 90 is also disposed within and is threadedly engaged with a threaded slip plate 23. The first shaft 90 is supported at one end by bearings 110. The bearings 110 are fastened to a helical gear 150 by means of a collar 120 and bolts 140, so that the first shaft 90 is allowed to rotate independently of the helical gear 150. However, the shaft 90 cannot move laterally independently of the helical gear 150. A gear 130 is fastened to the first shaft 90. The gear 130 engages with a first motor (not shown).

The second precision-threaded shaft 100 is disposed within and is threadedly engaged with a backlash nut 220.

The second shaft 100 is supported by bearings 170. The bearings 170 are connected to the plate cylinder journal 2 by means of bolts 180, 190, and a gear 200 which is fastened to the end of the journal 2, so that the second shaft 100 is allowed to rotate independently of the journal 2. However, the second shaft 100 cannot move laterally independently of the journal 2. A gear 160 is fastened to the second shaft 100. The gear 160 engages with a second motor (not shown).

In a first mode of operation, the prior art device of FIG. 1 adjusts the circumferential register of the plate cylinder 1 by rotation of the first threaded shaft 90. When the first shaft is rotated by its gear 130, the first shaft 90 moves laterally due to its threaded engagement with the plate 230. The lateral motion of the first shaft 90 is transmitted through bearings 110, collar 120, and bolts 140 to the helical gear 150. The helical gear 150 is engaged with another helical gear (not shown) attached to the end of a blanket cylinder (not shown) of the press. When the helical gear 150 is moved laterally, the relative circumferential positions of the plate cylinder 10 and blanket cylinder (not shown) are changed, achieving circumferential registering.

In a second mode of operation, the prior-art device of FIG. 1 adjusts the lateral register of the plate cylinder 1 by rotation of the second shaft 100. When the second shaft 100 is rotated by its gear 160, the second shaft 100 moves laterally due to its threaded engagement with the plate 220. This lateral motion is transmitted to the plate cylinder 1 by means of the bearings 170, bolts 180, 190, gear 200, and journal 2, achieving lateral registering.

Figure 2:
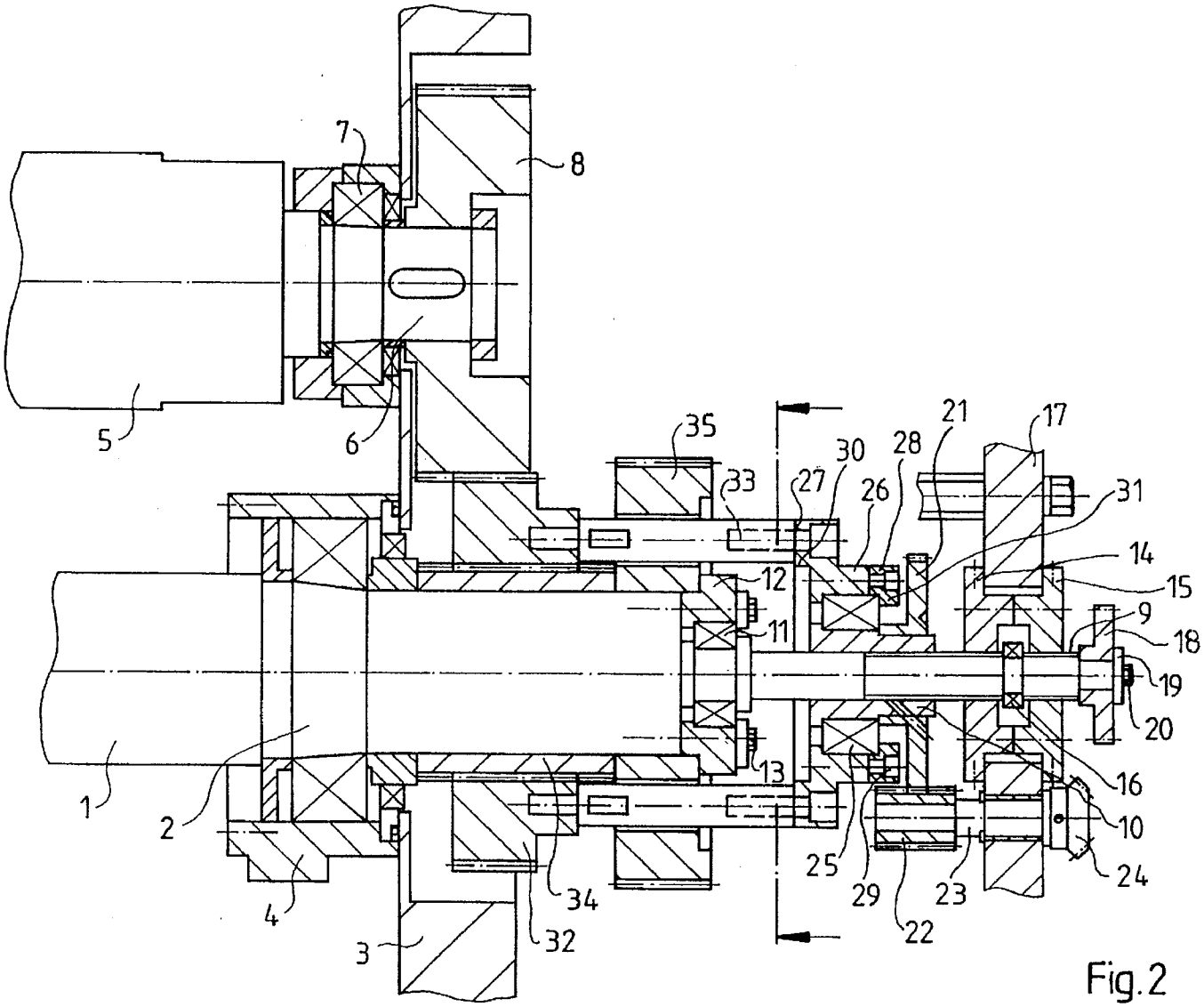
FIG. 2 shows a cross-sectional view of the adjustment-side of a rotary printing press including a device in a accordance with an embodiment of the present invention.
Figure 3:
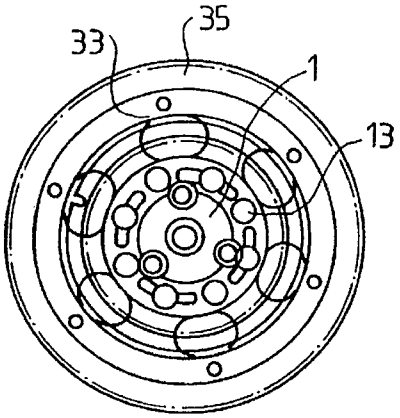
FIG. 3 is a longitudinal view of the device of FIG. 2, along the line A—A.
Figure 4:
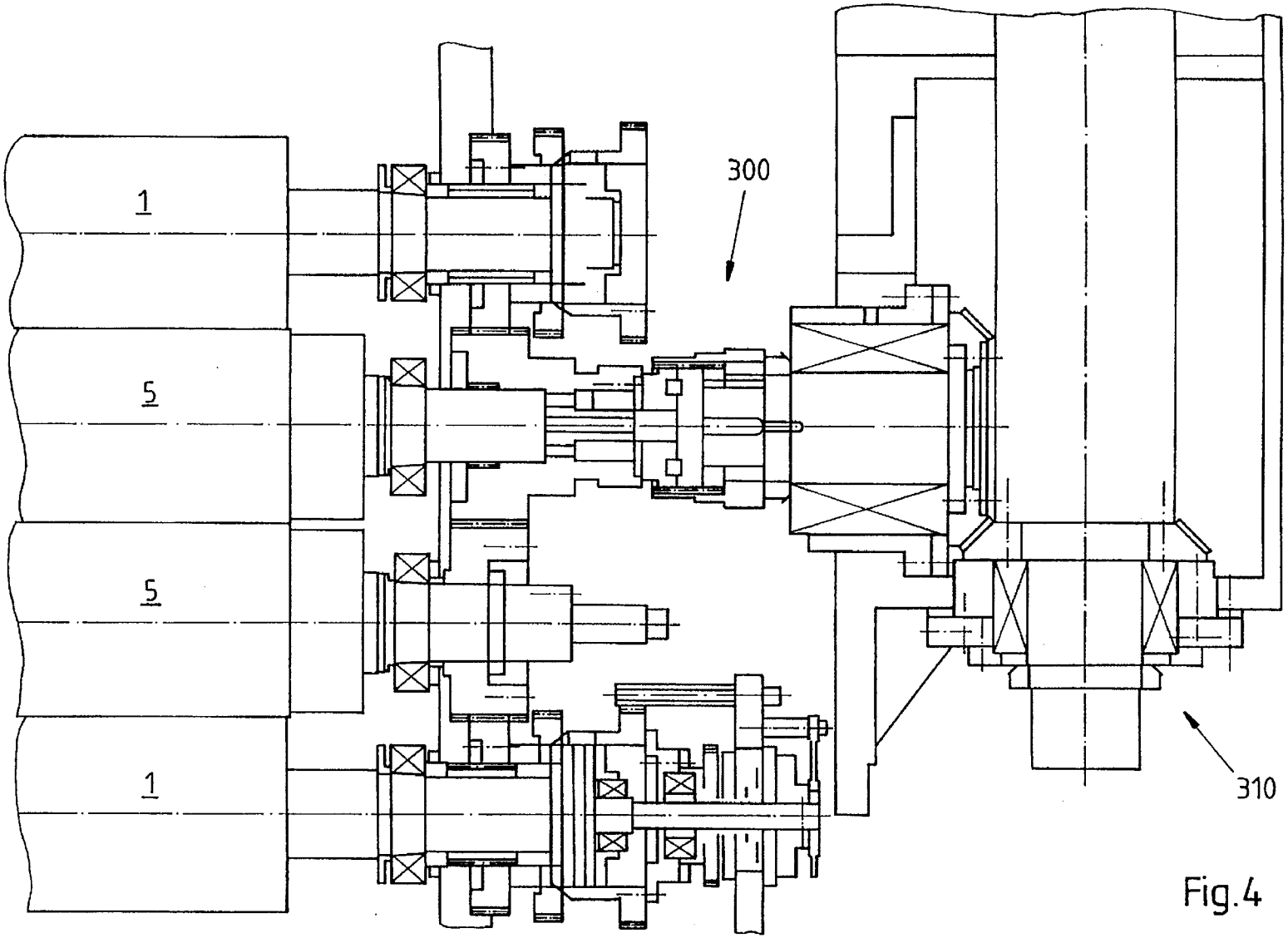
FIG. 4 is a view of the drive side of the embodiment of FIG. 2.

In contrast, FIGS. 2–4 show an apparatus for adjusting the lateral and circumferential registry of a cylinder in accordance with an embodiment of the present invention. In accordance with the apparatus of FIGS. 2–4, a single shaft provides both lateral and circumferential registry. Referring to FIG. 2, a plate cylinder 1 is connected to an adjustment-side journal 2 and a drive-side journal (not shown). The journals are rotatably mounted in their respective side frames 3 by means of bearing assemblies 4. A blanket cylinder 5 is likewise connected to an adjustment-side journal 6 and a drive-side journal (not shown). These journals are likewise rotatably mounted in their respective side frames 3 by means of bearing assemblies 7. A helical gear 8 is fastened to the end of the blanket cylinder's adjustment side journal 6.

A single precision-threaded shaft 9 is disposed within a sleeve 10 and is threadedly engaged with the sleeve 10. The shaft 9 is supported at one end by bearings 11. The bearings 11 are coaxially fastened to the end of the plate cylinder's adjustment-side journal 2 by means of a collar 12 and bolts 13, so that the shaft 9 is allowed to rotate independently of the plate cylinder 1. However, the shaft 9 cannot move laterally independently of the plate cylinder 1. The shaft 9 is also disposed within and is threadedly engaged with nut plates 14, 15. The nut plates 14, 15, are fastened together, and the assembly consisting of 14 and 15 is fitted into an opening in a register drive plate 17. A threaded clamp collar 16 is provided to act as a mechanical stop in the lateral direction. At the other end of the shaft 9, a gear 18 is fastened with a washer 19 and bolt 20, so that the gear 18 cannot rotate independently of the shaft 9. The gear 18 engages a first motor (not shown). In the embodiment of the present invention illustrated in FIG. 2, the first motor and the gear 18 make up the shaft drive of the shaft 9.

The sleeve 10 is disposed within and is fastened to a gear 21. The gear 21 is externally engaged with a pinion 22. The pinion 22 is fastened coaxially to a shaft 23. The pinion 22 is long enough in the lateral direction to remain engaged with the gear 21 throughout the length of the gear's 21 lateral travel. The shaft 23 passes through the register drive plate 17. A bevel gear 24 is coaxially fastened to the end of the shaft 23 outside of the side plate 17. The bevel gear 24 engages with a second motor (not shown). Together, the second motor, the bevel gear 24, shaft 23, pinion 22, and gear 21 make up the sleeve drive of the sleeve 10 in the embodiment of the present invention illustrated in FIG. 2.

The sleeve 10 is supported by bearings 25 that leave the sleeve 10 free to turn circumferentially. However, the sleeve 10 is fitted within its bearings 25 such that the sleeve 10 cannot slip laterally within the bearings 25. The bearings 25 are disposed within a collar assembly 26 composed of an inner collar 27 and an outer collar 28, for ease of manufacture. The outer collar 28 is bolted to the inner collar 27 with bolts 29. The inner collar 27 has an integral lip 30, disposed such that the bearing 25 can push against the lip 30. Likewise, the outer collar 28 has an integral lip 31, disposed such that the bearing 25 can push against the lip 31.

The collar assembly 26 is connected to a helical gear 32 with four bolts 33. The helical gear 32 is externally engaged with the blanket cylinder's helical gear 8. Disposed within and engaged with the helical gear 32 is a straight spline 34. The straight spline 34 is disposed without, and is fitted to, the plate cylinder's adjustment-side journal 2 such that the spline 34 cannot rotate circumferentially independently of the plate cylinder 1. The straight spline 34 constrains the motion of the helical gear 32, preventing the helical gear 32 from rotating circumferentially relative to the plate cylinder 1.

A spur gear 35 is provided to drive the press's inker assembly (not shown). The spur gear 35 is driven by its engagement with the adjustment-side journal.

In a first mode of adjustment, the lateral register is actuated by rotation of the shaft 9. In this mode, the sleeve 10 is held immobile by the sleeve drive. The shaft drive drives the gear 18, which in turn rotates the shaft 9 in either the clockwise or counterclockwise direction. Since the shaft 9 is threadedly engaged with the nut plates 14, 15, and sleeve 10, the shaft 9 is driven laterally in a direction determined by the direction of its rotation. The shaft 9 pushes (or pulls) the plate cylinder 1 in the lateral direction by transmitting force through the shaft-supporting bearings 11. Thus, the plate cylinder 1 is moved laterally.

In a second mode of adjustment, the circumferential register is actuated by rotation of the sleeve 10. In this mode, the shaft 9 is held immobile by the shaft drive. The sleeve drive drives bevel gear 24, which in turn rotates sleeve 10 in either the clockwise or counterclockwise direction. Since the sleeve 10 is threadedly engaged with the immobilized shaft 9, the sleeve 10 is driven laterally in a direction determined by the direction of its rotation.

The sleeve 10 transmits lateral force through its bearings 25, then through the collar assembly 26, then through the bolts 33, to the helical gear 32. The helical gear 32 is thus moved laterally, in a direction determined by the direction of the sleeve's 10 rotation. Because the helical gear 32 is engaged with the blanket cylinder's helical gear 8, the helical gear 32 is forced to turn circumferentially relative to the blanket cylinder 5. The circumferential motion of the helical gear 32 relative to the blanket cylinder 8 transmits circumferential force through the straight spline 34, causing the plate cylinder 1 to rotate circumferentially relative to the blanket cylinder 5. Thus, circumferential registration is achieved.

Referring to FIG. 4, during press operation the plate cylinder 1 and blanket cylinder 5 are rotated, for example, by a gear train 300 which is connected to a main drive gear box 310. The gear box 310 is driven by a DC electric motor via a belt (not shown). The plate cylinder's journals 2, helical gear 32, straight spline 34, spur gear 35, bolts 33, and collars 12, 26 rotate along with the plate cylinder 1. The blanket cylinder's helical gear 8 and journals 6 rotate along with the blanket cylinder. The shaft 9 and sleeve 10, supported as they are by their bearings 11, 25, do not rotate along with the plate cylinder 1. When the press is running, the shaft 9 is held immobile by the shaft drive, and the sleeve 10 is held immobile by the sleeve drive, unless the register is adjusted (as described above) while the press is running.

Figure 5:
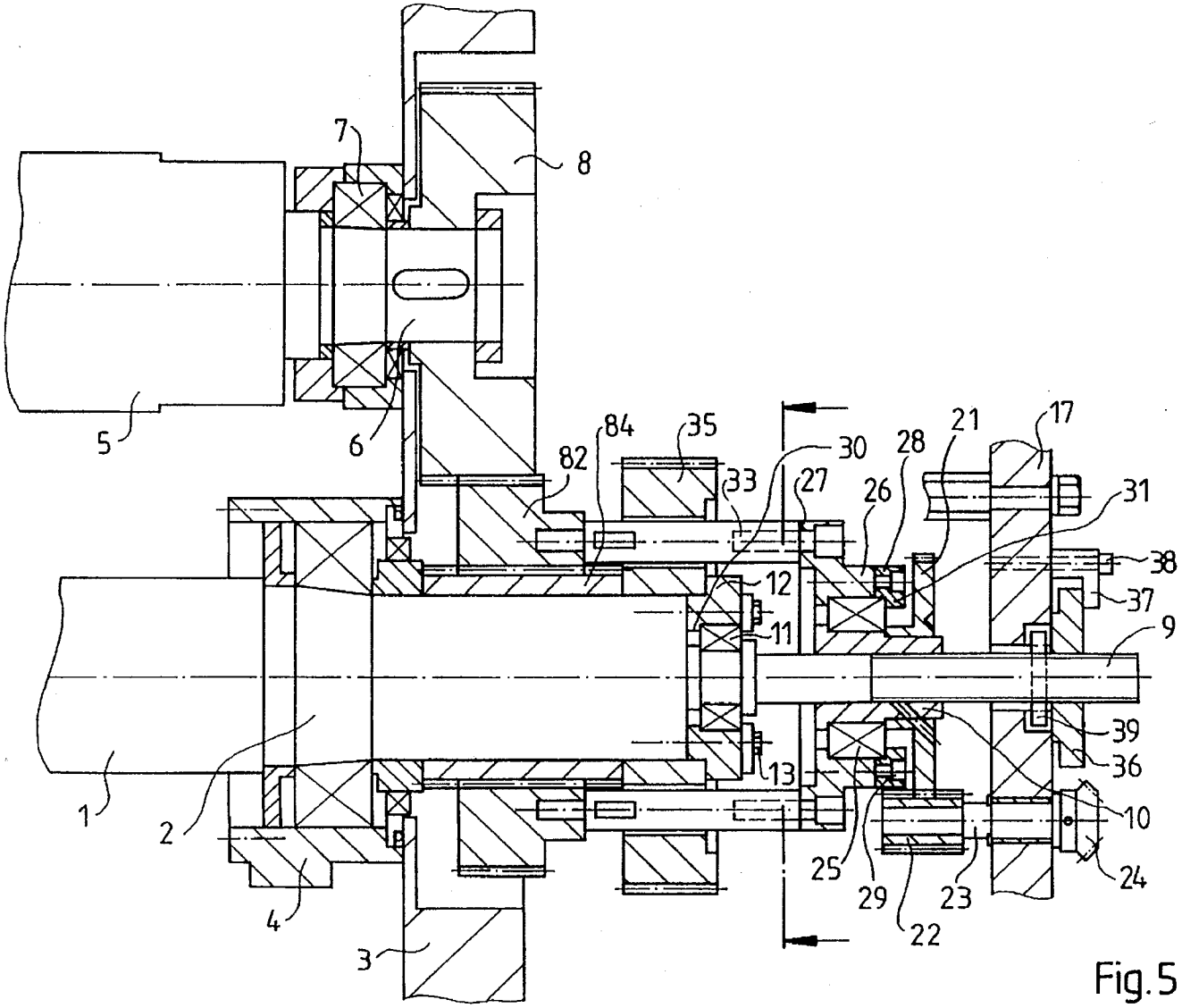
FIG. 5 is a cross-sectional view of an alternate embodiment of the present invention.

FIG. 5 shows another embodiment of the present invention, in which the helical gears 8, 32 of the embodiment of FIG. 2 are replaced by spur gears 88, 82, and the straight spline 34 of the embodiment of FIG. 2 is replaced by a helical spline 84. In addition, the gear 18 of the shaft drive is replaced with a gear 36. Components which are common to the embodiments of FIGS. 2 and 5 bear the same reference numerals.

Referring to FIG. 5, during lateral registration, shaft 9 is fixed from rotation relative to register drive plate 17 by a pin 39 pressed into shaft 9, and contained in a slot in plate 17. In addition, a bracket 37 is mounted in register drive plate 17 via bolt 38 in order to prevent axial movement of the gear 36. To achieve lateral registry, gear 36 is rotated by the first motor while the sleeve drive (gears 24, 21, shaft 23, pinion 22, and the second motor) is held immobile. As gear 36 rotates, it will move shaft 9 axially, but not rotationally, due to the threaded connection between shaft 9 and gear 36.

Circumferential register is achieved similarly to FIG. 2, except that when the sleeve 10 is rotated, it transmits lateral force through its bearings 25, then through the collar assembly 26, then through the bolts 33, to the spur gear 82. The spur gear 82 is thus moved laterally, in a direction determined by the direction of the sleeve's 10 rotation. Because the spur gear 82 is engaged with the blanket cylinder's spur gear 88, spur gear 82 is constrained to move only in the lateral direction, and not circumferentially, relative to the blanket cylinder 5. The lateral motion of the spur gear 82 relative to the blanket cylinder spur gear 88 transmits circumferential force through the helical spline 84, causing the plate cylinder 1 to rotate circumferentially relative to the blanket cylinder 5.

What is claimed is:

1. An apparatus for adjusting the lateral and circumferential position of a cylinder of a rotary printing press comprising:

a shaft disposed coaxially with the cylinder, the shaft rotatably connected with the cylinder, the shaft having an outer surface with threads disposed thereon;

a threaded sleeve disposed coaxially with the cylinder, the sleeve having an inner surface with threads disposed thereon which engage the threads disposed on the outer surface of the shaft;

a splined sleeve connected to and disposed coaxially with the cylinder and having an outer surface with a spline disposed, thereon;

a gear having an inner surface with a groove disposed thereon which engages the spline, the gear rotatably engaged with the threaded sleeve;

a first drive for axially moving the shaft without rotating the shaft, so that when the shaft is moved axially, the cylinder is moved laterally, a second drive for rotating the threaded sleeve, so that when the threaded sleeve is rotated the threaded sleeve moves the gear laterally, the gear driving the splined sleeve and thereby rotating the cylinder.

2. Apparatus of claim 1, wherein the first drive for axially moving the shaft comprises a pin, which is pressed into the shaft and which is contained in a slot formed in a drive plate of the printing press.

3. Apparatus of claim 1, wherein the first drive comprises a gear which is threadedly corrected to the shaft and which is axially unmovable with respect to the drive plate such that a rotation of the gear moves the shaft axially.

4. Apparatus of claim 1, wherein the spline is a helical spline and the gear is a spur gear.

5. Apparatus of claim 1, wherein the gear is disposed coaxially with the cylinder, and is disposed on the same end of the cylinder as the threaded sleeve.

6. An apparatus for adjusting the lateral and circumferential position of a cylinder of a rotary printing press, comprising:

a shaft disposed coaxially with the cylinder, the shaft rotatably connected with the cylinder, the shaft having an outer surface with threads disposed thereon;

a first sleeve disposed coaxially with the cylinder, the first sleeve having an inner surface with threads disposed thereon which engage the threads disposed on the outer surface of the shaft;

a second sleeve connected to and disposed coaxially with the cylinder, a gear having an inner surface which engages the second sleeve via a spline, the gear rotatably engaged with the first sleeve;

a first drive for axially moving the shaft without rotating the shaft, so that when the shaft is moved axially, the cylinder is moved laterally, a second drive for rotating the first sleeve, so that when the first sleeve is rotated, the first sleeve moves the gear laterally, the gear driving the second sleeve and thereby rotating the cylinder.

7. An apparatus for adjusting the lateral and circumferential position of a cylinder of a rotary printing press, comprising:

a shaft disposed coaxially with the cylinder, the shaft rotatably connected with the cylinder, the shaft having an outer surface with threads disposed thereon;

a first sleeve disposed coaxially with the cylinder, the first sleeve having an inner surface with threads disposed thereon which engage the threads disposed on the outer surface of the shaft;

a second sleeve connected to and disposed coaxially with the cylinder;

a gear having an inner surface which engages the second sleeve via a spline, the gear rotatably engaged with the first sleeve;

a first drive for rotating the shaft, so that when the shaft is rotated, the shaft moves the cylinder laterally, a second drive for rotating the first sleeve, so that when the first sleeve is rotated, the first sleeve moves the gear laterally, the gear driving the second sleeve and thereby rotating the cylinder.

* * * * *